US011448985B2

(12) United States Patent
Uzawa

(10) Patent No.: US 11,448,985 B2
(45) Date of Patent: Sep. 20, 2022

(54) IMAGE FORMING APPARATUS HAVING A FIXING UNIT OPERATED BY AC VOLTAGE

(71) Applicant: Canon Kabushiki Kaisha, Tokyo (JP)

(72) Inventor: Hiroki Uzawa, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/406,487

(22) Filed: Aug. 19, 2021

(65) Prior Publication Data

US 2022/0066359 A1 Mar. 3, 2022

(30) Foreign Application Priority Data

Aug. 27, 2020 (JP) ..... JP2020-143869

(51) Int. Cl.
*G03G 15/20* (2006.01)
*G03G 15/00* (2006.01)

(52) U.S. Cl.
CPC ..... *G03G 15/2014* (2013.01); *G03G 15/80* (2013.01)

(58) Field of Classification Search
CPC ..... G03G 15/2039; G03G 15/80
USPC ..... 399/67, 69, 88
See application file for complete search history.

(56) References Cited

U.S. PATENT DOCUMENTS 5,669,038 A * 9/1997 Kishimoto ..... G03G 15/2003 399/67
10,069,435 B2 9/2018 Itoh
11,188,019 B2 * 11/2021 Kakutani ..... G03G 15/80
2021/0364953 A1 * 11/2021 Nagashima ..... G03G 15/2039

* cited by examiner

*Primary Examiner* — William J Royer
(74) *Attorney, Agent, or Firm* — Venable LLP

(57) ABSTRACT

An image forming apparatus includes an image forming unit configured to form an image; a transferring unit configured to transfer the image formed by the image forming unit on a recording material; a fixing unit having a fixing heater, the fixing heater being configured to generate heat with electric power supplied from a commercial power source, and the fixing unit being configured to fix the image on the recording material by heating the recording material on which the image is transferred with the heat generated by the fixing heater; a memory configured to store resistance information representing a resistance value of the fixing heater; a zero-cross detection unit configured to detect a zero-cross timing of an AC voltage supplied from the commercial power source, and a voltage detection unit configured to detect a voltage value of AC voltage.

10 Claims, 7 Drawing Sheets

IMAGE FORMING APPARATUS HAVING A FIXING UNIT OPERATED BY AC VOLTAGE

BACKGROUND OF THE INVENTION

Field of the Invention

The present disclosure relates to an image forming apparatus configured to fix an image on a recording material, such as a sheet on which an image is formed, by heating the recording material.

Description of the Related Art

Some image forming apparatuses which form an image using an electrophotographic method include a fixing unit which heats a recording material to fix an image. It is important to efficiently supply electric power to the fixing unit to quickly control the temperature of the fixing unit for speeding up a printing process performed by the image forming apparatus.

For example, in an image forming apparatus having a copy function, it is required to shorten the a time from a start instruction of an operation to an output of a first product (FCOT: First Copy Output Time). Rapid temperature control for a fixing unit shortens the FCOT. By increasing an amount of power supplied to the fixing unit as much as possible, the rapid temperature control of the fixing unit will be achieved. However, since the amount of power available for the image forming apparatus is limited, the rapid temperature control of the fixing unit is also limited. U.S. patent Ser. No. 10/069,435 B2 discloses a technique for efficiently supplying a rated power of an image forming apparatus and the power close to an upper limit of a rated current to a fixing unit to shorten the FCOT. This image forming apparatus detects a voltage and a current supplied to the fixing unit to accurately detect the amount of electric power supplied to the fixing unit.

In order to detect the electric power supplied to the fixing unit to perform optimum temperature control of the fixing unit based on the detection result, it is necessary to accurately control the electric power source to the fixing unit. When the power is supplied to the fixing unit by phase control, a timing (zero-cross timing) at which an AC voltage supplied from a commercial power source becomes 0 [V] is detected. By determining the timing at which a bidirectional thyristor (triac) is turned on with reference to the zero-cross timing, the power source to the fixing unit is controlled.

In this case, the timing at which the triac is turned on depends on the detection accuracy of the zero-cross timing. For example, when the detection accuracy of the zero-cross timing is not high, the timing at which the triac is turned on deviates from an ideal timing. Due to this deviation, an error occurs between the amount of electric power supplied to the fixing unit and the ideal amount of electric power. When controlling the temperature of the fixing unit, it is necessary to control, including an influence of this error, the temperature so as not to exceed the rated power and the rated current of the image forming apparatus. Therefore, in some cases, it is not possible to supply a previously set power to a fixing heater of the fixing unit. Thus, the present disclosure is directed to provide an image forming apparatus which accurately supplies power to the fixing unit for controlling the temperature of the fixing unit with high accuracy.

SUMMARY OF THE INVENTION

An image forming apparatus according to the present disclosure includes: an image forming unit configured to form an image; a transferring unit configured to transfer the image formed by the image forming unit on a recording material; a fixing unit having a fixing heater, the fixing heater being configured to generate heat with electric power supplied from a commercial power source, and the fixing unit being configured to fix the image on the recording material by heating the recording material on which the image is transferred with the heat generated by the fixing heater; a memory configured to store resistance information representing a resistance value of the fixing heater; a zero-cross detection unit configured to detect a zero-cross timing of an AC voltage supplied from the commercial power source; a voltage detection unit configured to detect a voltage value of AC voltage supplied to the fixing heater from the commercial power source, a current detection unit configured to detect a current value of a current flowing in the fixing heater, a switching element, provided on a path for supplying electric power from the commercial power source to the fixing heater, configured to supply electric power to the fixing heater when the switching element is turned on; at least one processor configured to supply electric power to the fixing heater by changing the switching element into an ON state when a predetermined set time has elapsed since the zero-cross timing; wherein the at least one processor is configured to: determine a conduction ratio of the switching element based on the voltage value detected by the voltage detection unit, the current value detected by the current detection unit, and the resistance value information of the fixing heater; and correct a timing at which the switching element is turned on to reduce a difference between the determined conduction ratio and a predetermined conduction ratio.

Further features of the present invention will become apparent from the following description of exemplary embodiments (with reference to the attached drawings).

DESCRIPTION OF THE EMBODIMENTS

An image forming apparatus 1 according to at least one embodiment of the present disclosure is specifically described with reference to the drawings.

First Embodiment

Figure 1:
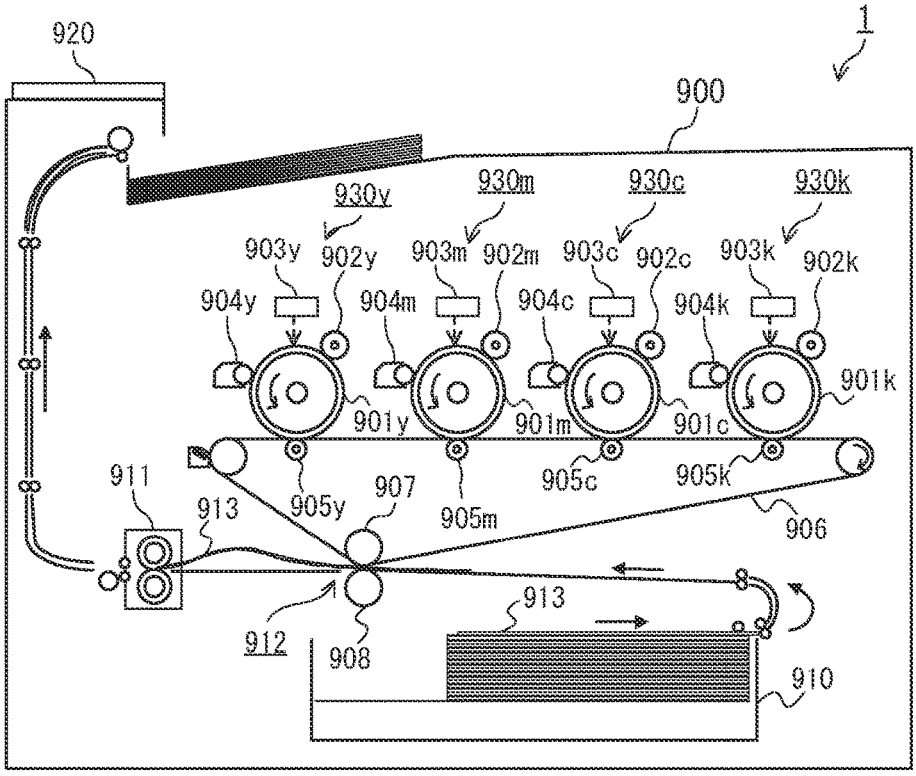
FIG. 1 is an explanatory configuration diagram of an image forming apparatus.

FIG. 1 is an explanatory configuration diagram of the image forming apparatus 1 according to one embodiment of the present disclosure. The image forming apparatus 1 has a printer 900. The printer 900 includes a yellow (y) image forming portion 930*y*, a magenta (m) image forming portion 930*m*, a cyan (c) image forming portion 930*c*, a black (k) image forming portion 930*k*, an intermediate transfer belt 906, a sheet feeding cassette 910, and a fixing unit 911.

Each image forming unit 930*y*, 930*m*, 930*c*, and 930*k* has the same configuration. In this embodiment, the configuration of the yellow image forming portion 930*y* is described, and a description of the configurations of the image forming portions 930*m*, 930*c*, and 930*k* for other colors is omitted. The yellow image forming portion 930*y* includes a photosensitive member 901*y*, a charging device 902*y*, a laser unit 903*y*, and a developing device 904*y*. Each charging device 902*y*, 902*m*, 902*c*, and 902*k* has the same configuration. Each laser unit 903*y*, 903*m*, 903*c*, and 903*k* has the same configuration. Each developing device 904*y*, 904*m*, 904*c*, and 904*k* has the same configuration.

The photosensitive member 901*y* has a drum shape, and rotates about a drum axis counterclockwise in FIG. 1. The charging device 902*y* uniformly charges the surface of the rotating photosensitive member 901*y*. The laser unit 903*y* radiates laser light, which is modulated in accordance with yellow image data, to a charged surface of the photosensitive member 901*y*. Through irradiation with the laser light, an electrostatic latent image is formed on the surface of the photosensitive member 901*y* in accordance with the yellow image data. The developing device 904*y* develops the electrostatic latent image formed on the surface of the photosensitive member 901*y* with the use of yellow developer. In this manner, a developer image is formed on the surface of the photosensitive member 901*y* in accordance with the yellow image data.

Similarly, a developer image is formed on a surface of a photosensitive member 901*m* of the magenta image forming portion 930*m* in accordance with magenta image data. A developer image is formed on a surface of a photosensitive member 901*c* of the cyan image forming portion 930*c* in accordance with cyan image data. A developer image is formed on a surface of a photosensitive member 901*k* of the black image forming portion 930*k* in accordance with black image data.

The respective photosensitive members 901*y*, 901*m*, 901*c*, and 901*k* are in contact with the intermediate transfer belt 906. At positions opposed to the photosensitive members 901*y*, 901*m*, 901*c*, and 901*k* across the intermediate transfer belt 906, there are provided primary transfer rollers 905*y*, 905*m*, 905*c*, and 905*k*, respectively. By applying a voltage to the primary transfer rollers 905*y*, 905*m*, 905*c*, and 905*k*, the developer images of the respective colors formed on the respective photosensitive members 901*y*, 901*m*, 901*c*, and 901*k* are transferred onto the intermediate transfer belt 906. The intermediate transfer belt 906 rotates clockwise in FIG. 1. At the timing corresponding to a rotational speed of the intermediate transfer belt 906, the developer images are sequentially transferred from the respective photosensitive members 901*y*, 901*m*, 901*c*, and 901*k* so that the developer images are formed on the intermediate transfer belt 906 in a superimposed manner. Then, full-color developer images are formed on the intermediate transfer belt 906.

The developer images formed on the intermediate transfer belt 906 are conveyed to a secondary transfer portion 912 by the rotation of the intermediate transfer belt 906. The secondary transfer portion 912 is formed of a secondary transfer inner roller 907 and a secondary transfer outer roller 908. In synchronization with the timing at which the developer images formed on the intermediate transfer belt 906 are conveyed to the secondary transfer portion 912, a recording material 913 such as a sheet is conveyed to the secondary transfer portion. The secondary transfer portion 912 conveys the intermediate transfer belt 906 and the recording material 913 while nipping the intermediate transfer belt 906 and the recording material 913 between the secondary transfer inner roller 907 and the secondary transfer outer roller 908. At this point, by applying a voltage to the secondary transfer portion 912, the developer images are transferred from the intermediate transfer belt 906 onto the recording material 913. The recording materials 913 are received in the sheet feeding cassette 910, and are fed one by one in synchronization with the timing at which the developer image is formed in the image forming portion 930*y*, 930*m*, 930*c*, and 930*k*. After the recording material 913 is fed, the skew feed of the recording material 913 is corrected, and the recording material 913 is conveyed to the secondary transfer portion 912 at the adjusted timing.

The recording material 913 having the developer images transferred thereon is conveyed to the fixing unit 911. The fixing unit 911 heats and pressurizes, after the developer is softened, the recording material 913 and the developer images to fix the developer images on the surface of the recording material 913. By the processing as above, the image forming processing on the recording material 913 is finished. The recording material 913 that has been subjected to the image forming is discharged from the fixing unit 911 to the outside of the image forming apparatus 1.

An operation unit 920 is provided in an upper part of the printer 900 as a user interface. The operation unit 920 is a user interface which includes an input device such as key buttons and a touch panel, and an output device such as a display and a speaker. The image forming apparatus 1 performs a print job to the recording material 913 according to the instructions input from the operation unit 920. The user can set various conditions (number of recording materials, size of the recording material, type of the recording material, etc.) at the time of image forming via a setting screen displayed on the display of the operation unit 920.

Figure 2:
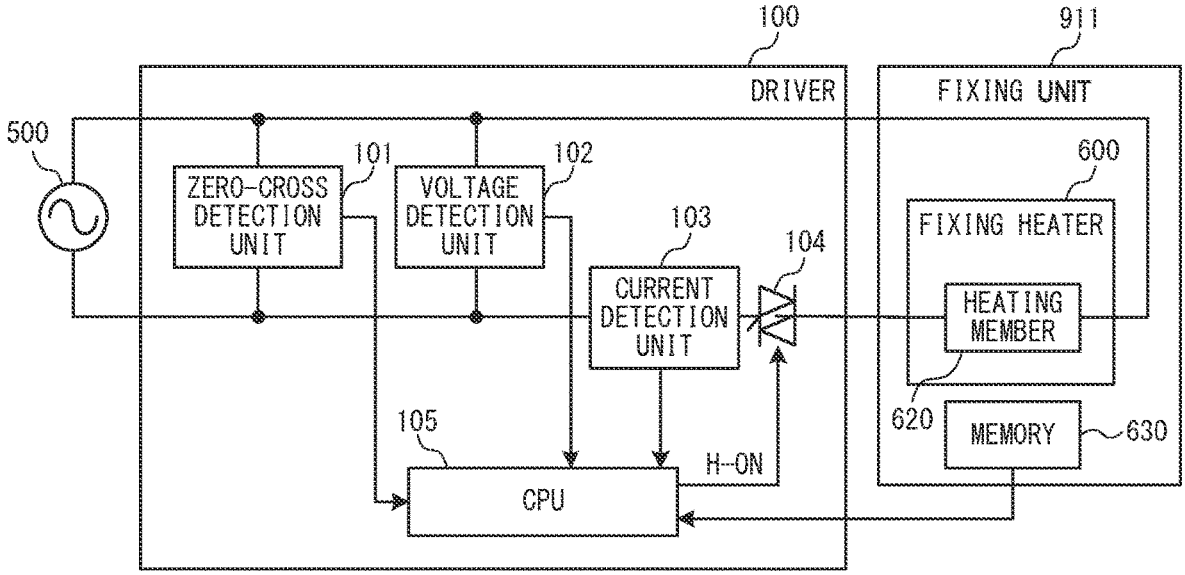
FIG. 2 is an explanatory diagram of a driver which controls an operation of a fixing unit.

FIG. 2 is an explanatory diagram of a driver which controls an operation of a fixing device 911. The fixing unit 911 is driven and controlled by a driver 100. The fixing unit 911 is heated by electric power supplied from an external commercial power source 500 via the driver 100. The power supply to the fixing unit 911 is controlled by the driver 100. The driver 100 controls an operation of the fixing unit 911, for example, by an instruction from a main controller (not shown) which controls the overall operations of the image forming apparatus 1.

The fixing unit 911 includes a fixing heater 600 for heating the recording material 913. The fixing heater 600 includes a heating member 620 as a heat source in its inside. The heating member 620 generates heat with an amount of heat generated according to the amount of electric power supplied. A thermistor (not shown) for detecting a temperature is arranged near the center of the fixing heater 600. Further, a memory 630 is installed in the fixing unit 911. The memory 630 stores resistance value information representing a resistance value of the fixing heater 600 (heating member 620). For example, a ROM (Read Only Memory) is used as the memory 630.

The driver 100 includes a zero-cross detection unit 101, a voltage detection unit 102, a current detection unit 103, a triac 104, which is a bidirectional thyristor, and a CPU (Central Processing Unit) 105. The CPU 105 can turn on (conduct) the triac 104 at a predetermined conduction ratio by transmitting a heater-on signal (H-ON), which is a control signal to the triac 104. The triac 104 is provided on a path for supplying power from the commercial power source 500 to the fixing unit 911. The triac 104 is a switching element which supplies electric power to the fixing heater 600 (heating element 620) when it is turned on.

The zero-cross detection unit 101 detects the zero-cross timing of the AC voltage supplied from the commercial power source 500. The zero-cross detection unit 101 detects timing when the absolute value of an AC voltage supplied from the commercial power source 500 becomes equal to or less than a predetermined value. The detected timing is the zero-cross timing. When the zero-cross detection unit 101 detects the zero-cross timing, the zero-cross detection unit 101 transmits a pulse signal (zero-cross signal), which indicates that the zero-cross timing has been detected, to the CPU 105. The voltage detection unit 102 detects the voltage value V of the AC voltage supplied from the commercial power source 500 and transmits it to the CPU 105. The current detection unit 103 detects the current value I of the current flowing through the fixing unit 911 and transmits it to the CPU 105.

The CPU 105 detects the zero-cross timing by obtaining the zero-cross signal from the zero-cross detection unit 101. The CPU 105 squares an instantaneous value of a voltage value V obtained from the voltage detection unit 102 at a predetermined sampling frequency (20 kHz in this embodiment), with the zero-cross timing being a base point (or a starting point), and sums the squares of the instantaneous values. Assuming that the instantaneous value of the voltage value V sampled at the nth time (n is a natural number) is V(n) and the number of samplings until the next zero-cross timing is N (N is a natural number), the effective voltage value Vrms of the voltage value V of the AC voltage is expressed by the following equation.

$$Vrms = \sqrt{\frac{1}{N}\sum_{n=1}^{N} V(n)^2} \quad \text{(Formula 1)}$$

The CPU 105 squares an instantaneous value of a current value I obtained from the current detection unit 103 at a predetermined sampling frequency (20 [kHz] in this embodiment), with the zero-cross timing being a base point, and sums the squares of the instantaneous values. Assuming that the instantaneous value of the current value I sampled at the nth time (n is a natural number) is I(n) and the number of samplings until the next zero-cross timing is N (N is a natural number), the effective current value Irms of the current value I is expressed by the following equation.

$$Irms = \sqrt{\frac{1}{N}\sum_{n=1}^{N} I(n)^2} \quad \text{(Formula 2)}$$

Figure 3:
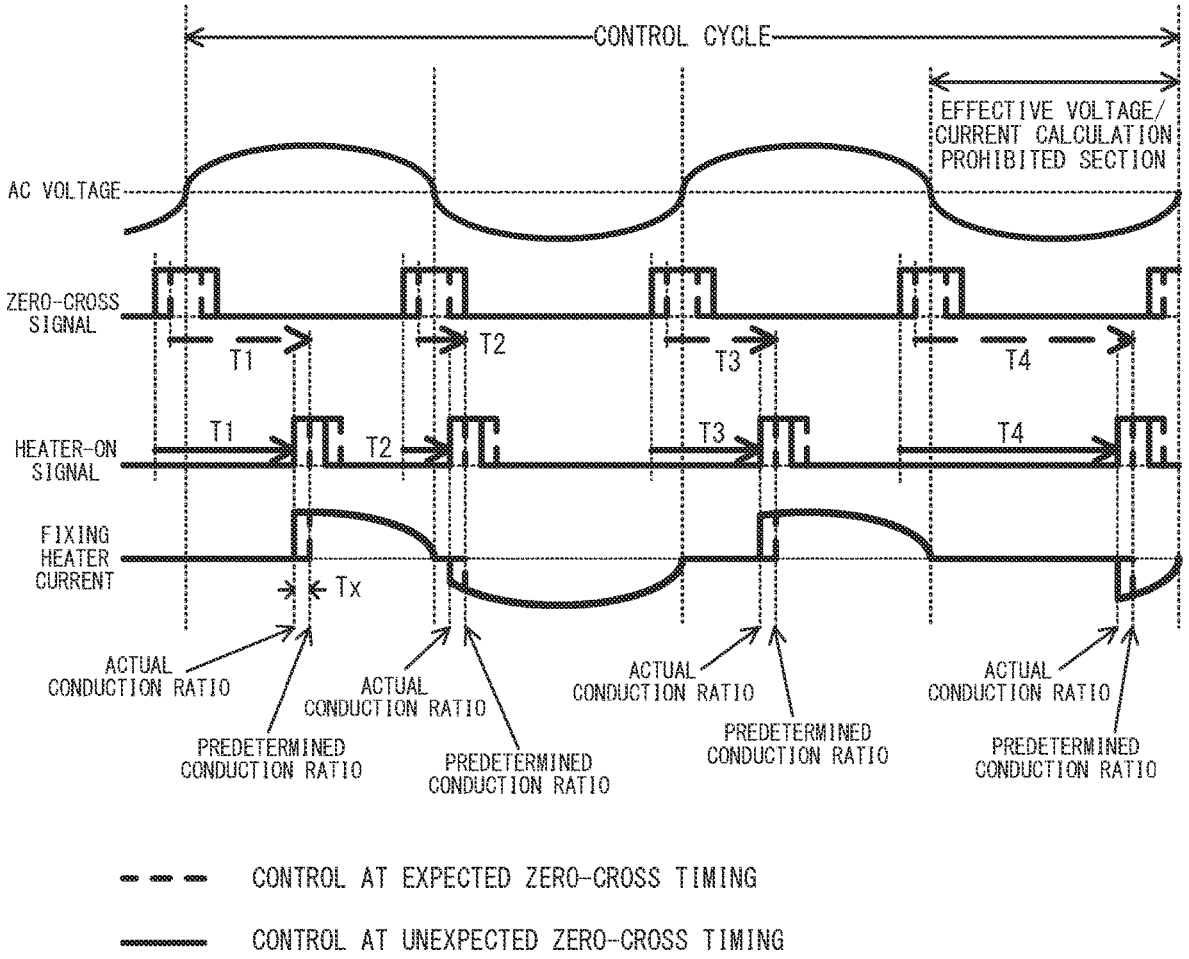
FIG. 3 is a timing chart of a control process to turn ON a fixing heater.

FIG. 3 is a timing chart of a control process to turn ON the fixing heater 600.

The CPU 105 transmits, after elapse of a predetermined set time Tn, with the obtaining timing of zero-cross signal (zero-cross timing) being a base point, heater-on signal to the triac 104. The set time Tn is previously stored in a table and is set for each control cycle. In FIG. 3, each of set times T1 to T4 is set for the respective control cycle (corresponding to two cycles of the AC voltage supplied from the commercial power source 500). For at least a half-wave, during a period excluding the last half-wave of the AC voltage in one control cycle, in which the triac 104 is on, the CPU 105 compares an actual conduction ratio of the triac 104 with an ideal predetermined conduction ratio. Based on a voltage value V obtained from the voltage detection unit 102, a current value I obtained from the current detection unit 103, and a resistance value information stored in the memory 630, the CPU 105 determines the actual conduction ratio of the triac 104.

In a case where the actual timing of the zero-cross timing deviates from an expected timing (solid line in FIG. 3), a transmitting timing of the heater-on signal to the triac 104 also deviates according to the deviation of the zero-cross timing. Therefore, a difference occurs between the actual conduction ratio and a predetermined conduction ratio. The difference corresponds to an amount of deviation of the zero-cross timing. The heater-on signal is determined based on the timing at which the zero-cross signal reaches a high level (rising edge of pulse). The CPU 105 corrects the time from the zero-cross timing to the output of the heater-on signal (the time until the triac 104 is turned on) so that the difference between the actual conduction ratio and the predetermined conduction ratio becomes small. Specifically, the CPU 105 determines a time difference Tx such that the actual conduction ratio matches the predetermined conduction ratio, and adds the determined time difference Tx to the set time Tn.

The time for turning on the triac 104 is not corrected in the last half-wave of one control cycle (i.e., four half-waves of AC voltage) because it is not possible to complete the feedback of the correction before the next control cycle.

Figure 4:
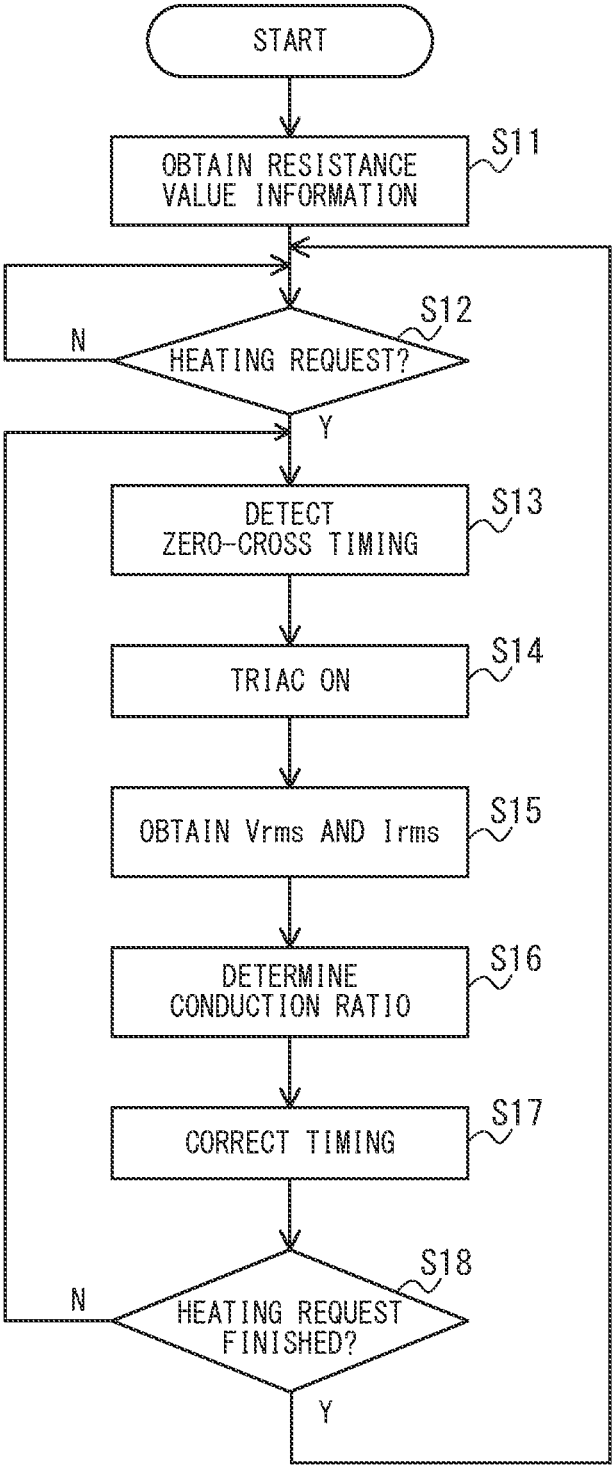
FIG. 4 is a flow chart representing a correction process for ON-timing of the fixing heater.

FIG. 4 is a flowchart representing a correction process for ON-timing of the fixing heater 600 executed by the CPU 105.

The CPU 105 obtains the resistance value information of the fixing heater 600 from the memory 630 (Step S11). The process of obtaining the resistance value information may be previously performed at a timing of initializing process after turning on the power, or at a timing of resuming from a power saving mode. The CPU 105 waits until a heating request for the fixing heater 600 is obtained from a main controller (not shown), which controls the operation of the image forming apparatus 1 (Step S12: N). When the heating request is obtained (Step S12: Y), the CPU 105 detects the zero-cross timing by obtaining the zero-cross signal from the zero-cross detection unit 101 (Step S13).

The CPU 105 outputs, after elapse of a previously set time T, with the detected zero-cross timing being a base point, the heater-on signal to turn on the triac 104 (Step S14). For at least a half-wave, during a period excluding the last half-wave in one control cycle, in which the triac 104 is on, the CPU 105 obtains the effective voltage value Vrms and the effective current Irms from a detection result of the voltage detection unit 102 and the current detection unit 103 (Step S15). From the effective voltage value Vrms and the resistance value information, the effective current value when power is supplied to the fixing heater 600, with the conduction ratio of the triac 104 being 100%, can be determined. The CPU 105 determines the actual conduction ratio of the triac 104 by comparing a determination result of the effective current value with the effective current value Irms obtained in the process of Step S15 (Step S16). The determination result of the effective current value is determined based on the effective voltage value Vrms and the resistance value information. Details of a method for determining the conduction ratio will be described later.

Before the next control cycle, to match the determined actual conduction ratio with the ideal predetermined conduction ratio, the CPU 105 corrects the time from the zero-cross timing to a time at which the heater-on signal is output (i.e., the time until the triac 104 is turned on) (Step S17). The CPU 105 repeats the processes Step S13 to Step S17 until the heating request is completed (Step S18: N). When the heating request is completed (Step S18: Y), the CPU 105 returns to Step S12 and waits for the next heating request again.

The method of determining the actual conduction ratio of the triac 104 will be described. The determination result (Irms) of the effective current value of the current flowing through the fixing heater 600 when the triac 104 is turned on, at a predetermined conduction ratio of C %, is obtained by the following equation. This equation includes an effective voltage value Vrms representing an effective value of an AC voltage supplied from the commercial power source 500, a resistance value R of the heating member 620, and a conduction angle θ(=cπ/100).

$$Irms = \sqrt{\frac{1}{\pi}\int_0^{\theta}\left(\frac{\sqrt{2}\,Vrms}{R}\sin\theta\right)^2 d\theta} \quad \text{(formula 3)}$$

$$Irms = \frac{Vrms}{R}\sqrt{\frac{\left(\theta - \frac{1}{2}\sin 2\theta\right)}{\pi}} \quad \text{(formula 4)}$$

Figure 5:
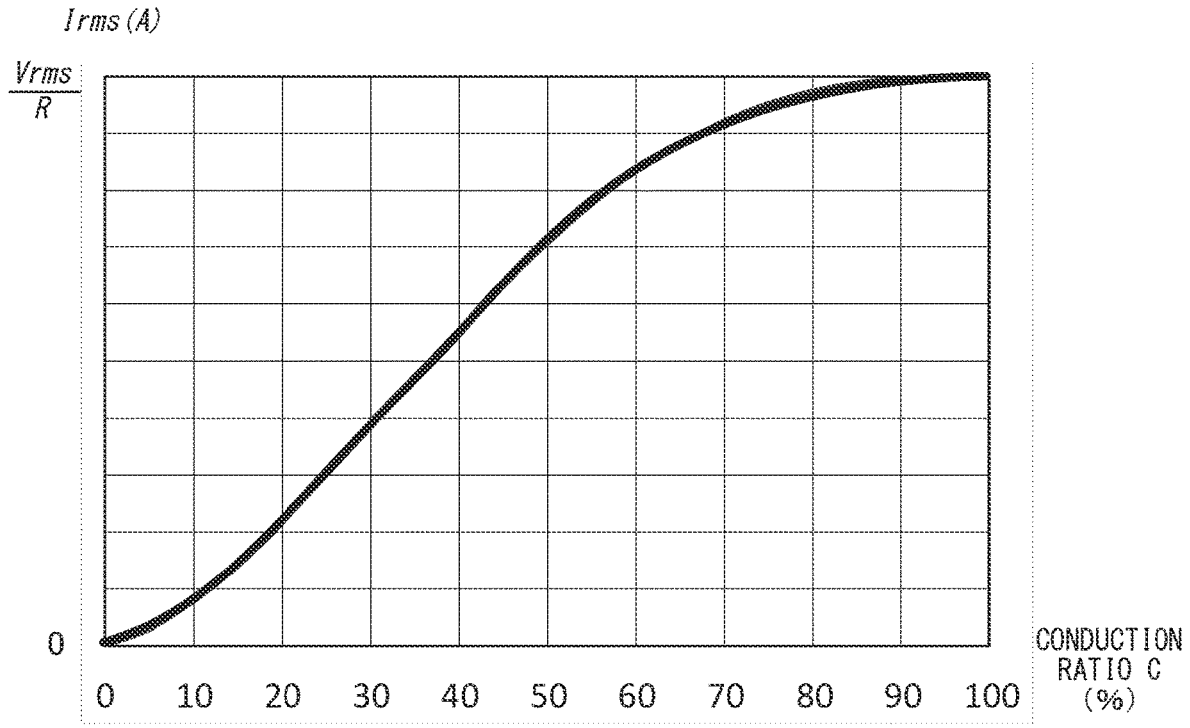
FIG. 5 is a graph representing a relationship between a conduction ratio and an effective current value.

FIG. 5 is a graph representing the relationship between the conduction ratio C and the effective current value Irms. FIG. 5 is a graph representing Formula 4. The CPU 105 can determine the actual conduction ratio C by substituting the effective voltage value Vrms, the effective value Irms, and the resistance value R according to the resistance value information obtained from the memory 630 into Formula 4.

By adjusting the timing at which the triac 104 is turned on according to the current value of the fixing heater 600 as described above, it is possible to efficiently supply electric power to the fixing heater 600. This will provide the maximum power which is allowable to be supplied to the fixing heater 600. Therefore, FCOT can be shortened.

Second Embodiment

In the first embodiment, the power supply timing to the fixing heater 600 is adjusted based on the effective current value, however, in the second embodiment, this adjustment is performed based on an effective power value. Since the configuration of the image forming apparatus 1 and the configuration of the controller for controlling the operation of the fixing unit 911 are the same as those in the first embodiment, the description thereof will be omitted.

The CPU 105 detects the zero-cross timing based on the zero-cross signal obtained from the zero-cross detection unit 101. The CPU 105 adds, at a predetermined sampling frequency (20 kHz in this embodiment), with the zero-cross timing being a base point, products of the instantaneous value of the voltage value V obtained from the voltage detection unit 102 and the instantaneous value of the current value I obtained from the current detection unit 103. The power consumption P of the fixing heater 600 is expressed by the following equation (wherein the instantaneous values of the voltage value V and the current value I, sampled at the nth time (n is a natural number), are V (n) and I (n), respectively, and the number of samplings until the next zero-cross timing is N (N is a natural number)).

$$P = \frac{1}{N}\sum_{n=1} V(n)I(n) \quad \text{(Formula 5)}$$

Figure 6:
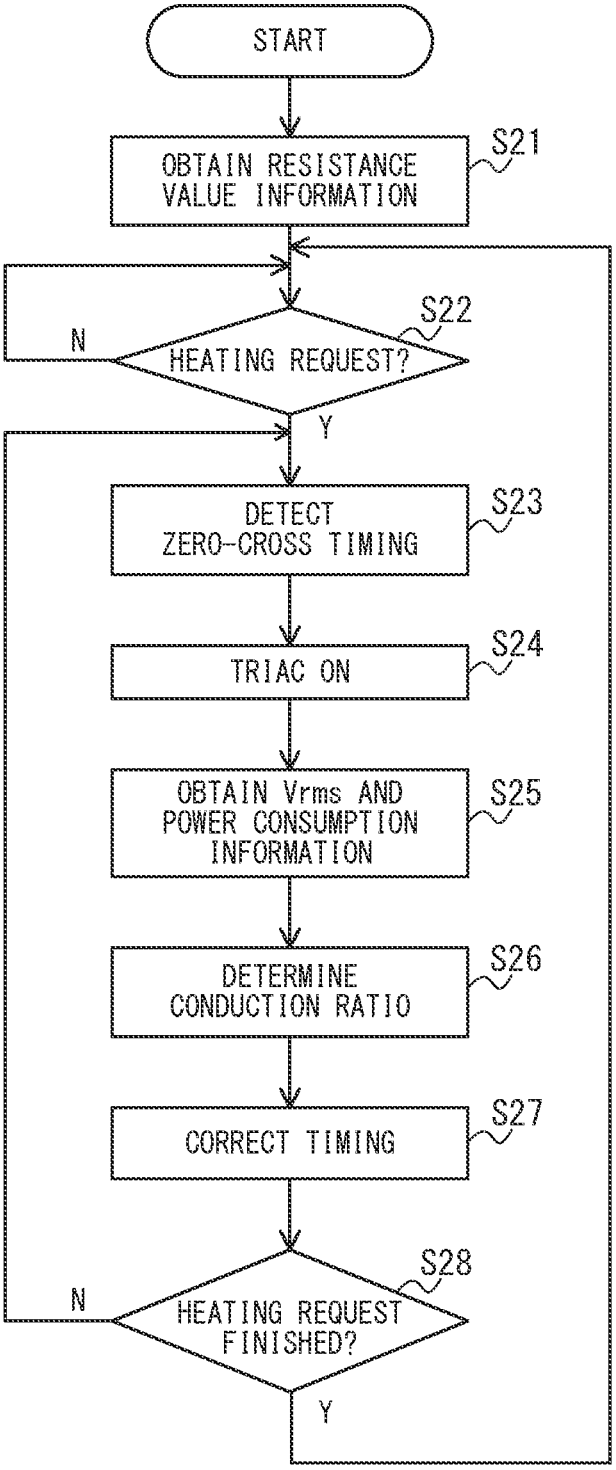
FIG. 6 is a flow chart representing a correction process for ON-timing of the fixing heater.

FIG. 6 is a flowchart representing a correction process for ON-timing of the fixing heater 600 of the second embodiment. Similar to the processes of Step S11 to Step S14 of the first embodiment of FIG. 4, the CPU 105 performs the processes from obtaining the resistance value information to turn on the triac 104 (Steps S21 to S24).

For at least a half-wave, during a period excluding the last half-wave of AC in one control cycle, in which the triac 104 is on, the CPU 105 obtains the effective voltage value Vrms and the power consumption information of the fixing heater 600 (Step S25). The power consumption information of the fixing heater 600 represents the power consumption of the fixing heater 600 (the heating member 620), and is previously stored in the memory 630 and read by the CPU 105, for example. Based on the effective voltage value Vrms, the resistance value information, and the predetermined conduction ratio, the power consumption P of the fixing heater 600 when the triac 104 is turned on with the predetermined conduction ratio is determined. Therefore, the CPU 105 can determine an actual conduction ratio of the triac 104 by comparing the determined power consumption P with the power consumption information (Step S26). The detailed method for determining the conduction ratio will be described later.

Before the next control cycle, to match the determined actual conduction ratio with the ideal predetermined conduction ratio, the CPU 105 corrects the time from the zero-cross timing to a time at which the heater-on signal is output (i.e., the time until the triac 104 is turned on) (Step S27). The CPU 105 repeats the processes Step S23 to Step S27 until the heating request is completed (Step S28: N). When the heating request is completed (Step S28: Y), the CPU 105 returns to Step S22 and waits for the next heating request again.

The method of determining the actual conduction ratio of the triac 104 will be described. The power consumption P of the fixing heater 600 when the triac 104 is turned on, at the predetermined conduction ratio of C %, is obtained by the following equation. This equation includes an effective voltage value Vrms representing an effective value of an AC voltage supplied from the commercial power source 500, a resistance value R of the heating member 620, and a conduction angle θ (=cπ/100).

$$P = \frac{1}{\pi}\int_0^{\theta}\left(\sqrt{2}\,Vrms\,\sin\theta\right)\left(\frac{\sqrt{2}\,Vrms}{R}\sin\theta\right)d\theta \quad \text{(Formula 6)}$$

$$P = \frac{Vrms^2}{R}\frac{\left(\theta - \frac{1}{2}\sin 2\theta\right)}{\pi} \quad \text{(Formula 7)}$$

Figure 7:
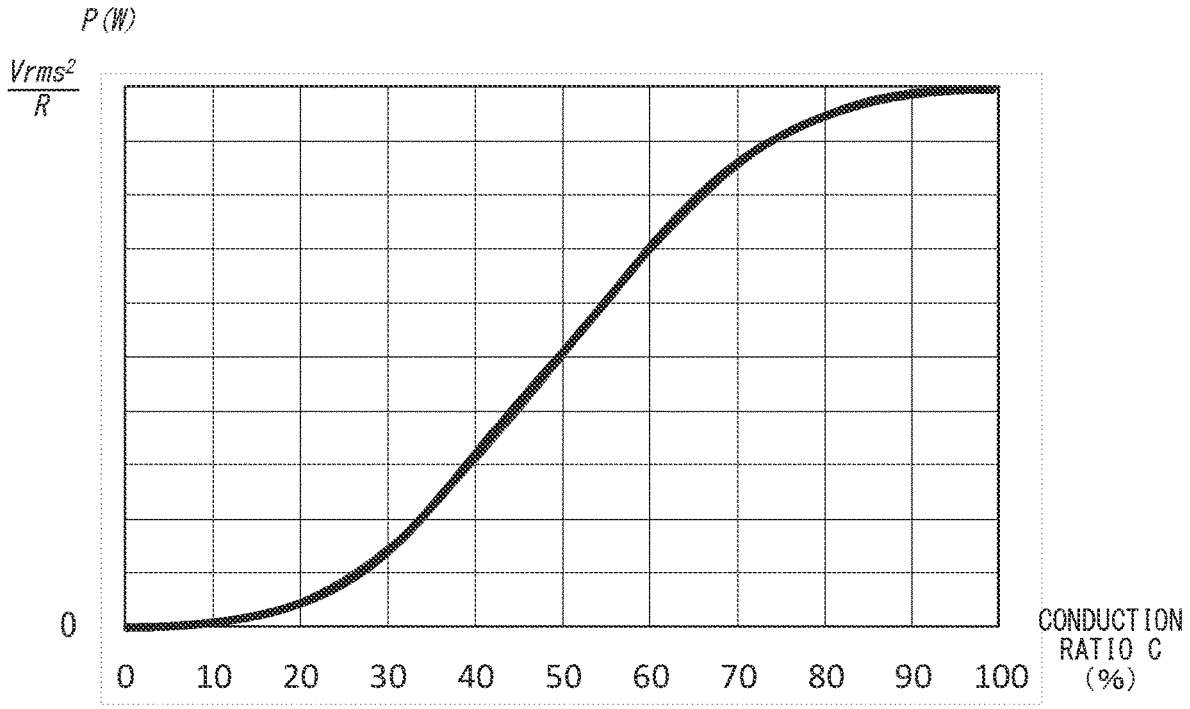
FIG. 7 is a graph representing a relation between a conduction ratio and power consumption.

FIG. 7 is a graph representing the relationship between the conduction ratio C and the power consumption P. FIG. 7 is a graph representing Formula 7. The CPU 105 can determine the actual conduction ratio C by substituting the effective voltage value Vrms and the resistance information R obtained from the memory 630 into Formula 7.

By adjusting the timing at which the triac 104 is turned on according to the power consumption of the fixing heater 600 as described above, it is possible to efficiently supply electric power to the fixing heater 600. This will provide the maximum power which is allowable to be supplied to the fixing heater 600. Therefore, FCOT can be shortened.

Third Embodiment

In the third embodiment, the on-timing correction method of the fixing heater 600 is different from that of the first embodiment and the second embodiment. Since the configuration of the image forming apparatus 1 and the configuration of the controller for controlling the operation of the fixing unit 911 are the same as those in the first embodiment, the description thereof will be omitted.

Figure 8:
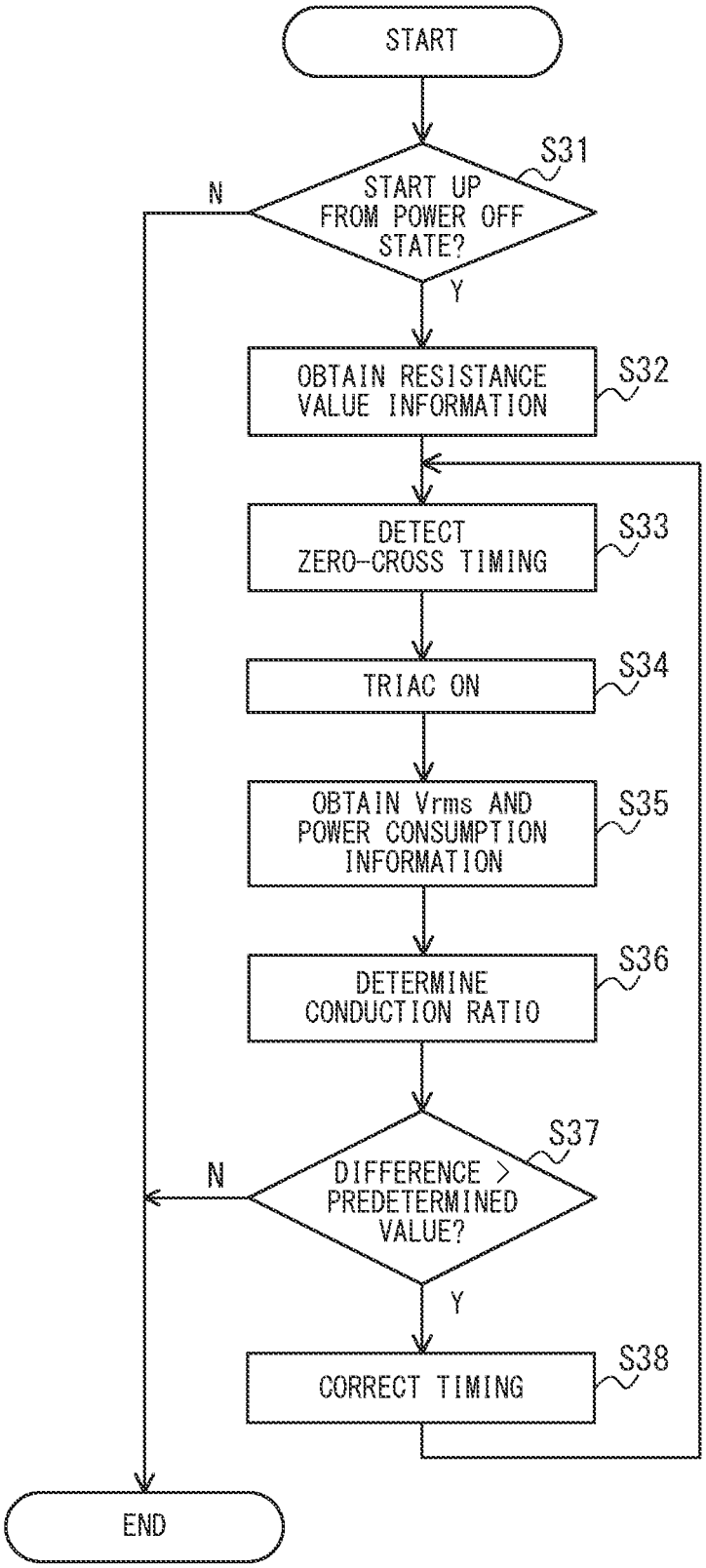
FIG. 8 is a flow chart representing a correction process for ON-timing of the fixing heater.

FIG. 8 is a flowchart representing a correction process for ON-timing of the fixing heater 600 of the third embodiment.

The CPU 105 determines whether a factor for starting the operation of the image forming apparatus 1 is the change of a state of the power switch from an OFF state to an ON state or resuming from a sleep state (Step S31). The reason why the zero-cross timing deviates from an expected timing includes the changes in the voltage value of the supplied AC voltage and the frequency of the AC voltage. These do not fluctuate significantly unless the power supply is cut off by turning off the power switch of the image forming apparatus 1. Therefore, when the factor for starting the operation of the CPU 105 is not the change of the state of the power switch from the OFF state to the ON state but returning from the power saving mode (sleep state) (Step S31: N), the process ends without adjusting the power supply timing to the fixing heater 600.

When the factor of starting the operation is the startup due to the state change of the power switch (Step S31: Y), the CPU 105 obtains the resistance value information from the memory 630 (Step S32). After that, the CPU 105 detects the zero-cross timing by obtaining the zero-cross signal from the zero-cross detection unit 101 (Step S33). The CPU 105 outputs, after elapse of a previously set time T, with the detected zero-cross timing being a base point, the heater-on signal to turn on the triac 104 with the conduction ratio 50% (Step S34). Here, at first, the conduction ratio is set to 50% because the deviation of the timing of power supply to the fixing heater 600 due to the deviation of the zero-cross timing becomes the largest at this ratio of 50%, thus the correction accuracy of the zero-cross timing is improved.

CPU 105 obtains, as in Step S25 in FIG. 6, the effective voltage value Vrms and the power consumption information of the fixing heater 600 (Step S35). From the effective voltage value Vrms and the resistance value information, the power consumption P of the fixing heater 600, with the conduction ratio of the triac 104 being 50%, is determined. CPU 105 can determine the actual conduction ratio of the triac 104 by comparing the determined power consumption P with the power consumption information (Step S36). The determination method of the actual conduction ratio is the same as that of the second embodiment.

The CPU 105 determines whether the difference obtained by comparing the conduction ratio of 50% and the actual conduction ratio exceeds a predetermined value or not (Step S37). In a case where the difference exceeds the predetermined value (Step S37: Y), the CPU 105 corrects the zero-cross timing so that the actual conduction ratio becomes 50% (Step S38). The CPU 105 repeats the processes Step S33 to Step S37 until the difference becomes less than or equal to the predetermined value. In a case where the difference becomes less than or equal to the predetermined value, CPU 105 ends the processing (Step S37: N).

As described above, the correction accuracy of the zero-cross timing is improved, and by adjusting the timing at which the triac 104 is turned on with high accuracy, it is possible to efficiently supply power to the fixing heater 600. This will provide the maximum power which is allowable to be supplied to the fixing heater 600. Therefore, FCOT can be shortened.

According to the image forming apparatus 1 of the present disclosure described in the first embodiment to the third embodiment, the electric power supply of the fixing unit 911 is performed correctly. Therefore, the image forming apparatus 1 can perform temperature control of the fixing unit 911 with high accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-143869, filed Aug. 27, 2020, which is hereby incorporated by reference herein in its entirety.

What is claimed is:

1. An image forming apparatus comprising:

an image forming unit configured to form an image;

a transferring unit configured to transfer the image formed by the image forming unit on a recording material;

a fixing unit having a fixing heater, the fixing heater being configured to generate heat with electric power supplied from a commercial power source, and the fixing unit being configured to fix the image on the recording material by heating the recording material on which the image is transferred with the heat generated by the fixing heater;

a memory configured to store resistance information representing a resistance value of the fixing heater;

a zero-cross detection unit configured to detect a zero-cross timing of an AC voltage supplied from the commercial power source;

a voltage detection unit configured to detect a voltage value of AC voltage supplied to the fixing heater from the commercial power source, a current detection unit configured to detect a current value of a current flowing in the fixing heater, a switching element, provided on a path for supplying electric power from the commercial power source to the fixing heater, configured to supply electric power to the fixing heater when the switching element is turned on;

at least one processor configured to supply electric power to the fixing heater by changing the switching element into an ON state when a predetermined set time has elapsed since the zero-cross timing;

wherein the at least one processor is configured to:

determine a conduction ratio of the switching element based on the voltage value detected by the voltage detection unit, the current value detected by the current detection unit, and the resistance value information of the fixing heater; and correct a timing at which the switching element is turned on to reduce a difference between the determined conduction ratio and a predetermined conduction ratio.

2. The image forming apparatus according to claim 1, wherein the at least one processor is configured to:

determine an actual conduction ratio of the switching element based on a difference between a current value determined based on the voltage value and the resistance value information and a current value detected by the current detection unit; and correct the timing at which the switching element is turned on to reduce a difference between the actual conduction ratio and the predetermined conduction ratio.

3. The image forming apparatus according to claim 2, wherein the at least one processor is configured to:

determine a time difference such that the actual conduction ratio matches the predetermined conduction ratio; and correct the timing at which the switching element is turned on based on the determined time difference.

4. The image forming apparatus according to claim 2, wherein the at least one processor is configured to:

determine an effective voltage value from the voltage value obtained based on the voltage detection unit;

determine an effective current value based on the current value obtained from the current detection unit; and determine the actual conduction ratio based on a difference between the effective current value and a current value which is determined based on the effective voltage value and the resistance value information.

5. The image forming apparatus according to claim 1, wherein the memory stores power consumption information which represents power consumption of the fixing heater, the at least one processor is configured to:

determine, based on the voltage value and the resistance value information, power consumption of the fixing heater when the switching element is turned on with the predetermined conduction ratio;

determine an actual conduction ratio of the switching element based on the determined power consumption and the power consumption information; and correct the timing at which the switching element is turned on to reduce a difference between the actual conduction ratio and the predetermined conduction ratio.

6. The image forming apparatus according to claim 5, wherein the at least one processor is configured to:

determine a time difference such that the actual conduction ratio matches the predetermined conduction ratio; and correct the timing at which the switching element is turned on based on the determined time difference.

7. The image forming apparatus according to claim 5, wherein the at least one processor is configured to:

determine an effective voltage value based on the voltage value obtained by the voltage detection unit; and determine the power consumption based on the determined effective voltage value, the resistance value information, and the predetermined conduction ratio.

8. The image forming apparatus according to claim 5, further comprising a power switch to supply electric power to the image forming apparatus, wherein the at least one processor is configured to:

determine, in a case where an operation of the image forming apparatus is started by changing a state of the power switch from an OFF state to an ON state, the power consumption of the fixing heater;

determine the actual conduction ratio of the switching element based on the determined power consumption and the power consumption information; and correct the set time to reduce a difference between the determined actual conduction ratio and the predetermined conduction ratio.

9. The image forming apparatus according to claim 8, wherein the predetermined conduction ratio is 50%.

10. The image forming apparatus according to claim 8, wherein the at least one processor is configured to:

repeatedly correct the set time until a difference between the conduction ratio of the switching element and the predetermined conduction ratio becomes less or equal to a predetermined value.

* * * * *